United States Patent [19]

Higgins, Jr.

[11] Patent Number: 4,940,955

[45] Date of Patent: Jul. 10, 1990

[54] TEMPERATURE COMPENSATED STRIPLINE STRUCTURE

[75] Inventor: Robert J. Higgins, Jr., Sunrise, Fla.

[73] Assignee: Motorola, Inc., Schaumburg, Ill.

[21] Appl. No.: 292,807

[22] Filed: Jan. 3, 1989

[51] Int. Cl.[5] ..... H01P 1/203; H01P 7/08

[52] U.S. Cl. ..... 333/204; 333/219; 333/234; 333/246

[58] Field of Search ..... 333/204, 205, 234, 246, 333/219, 235, 238

[56] References Cited

U.S. PATENT DOCUMENTS

| | | | |
|---|---|---|---|
| 3,534,301 | 10/1970 | Golembeski | 333/204 |
| 3,798,578 | 3/1974 | Konishi et al. | 333/229 |
| 3,840,828 | 10/1974 | Linn et al. | 333/205 |
| 4,218,664 | 8/1980 | Assal et al. | 333/246 X |
| 4,580,116 | 4/1986 | Ballato | 333/234 |
| 4,609,892 | 9/1986 | Higgins, Jr. | 333/204 |
| 4,661,790 | 4/1987 | Gannon et al. | 333/234 |

*Primary Examiner*—Eugene R. LaRoche
*Assistant Examiner*—Seung Ham
*Attorney, Agent, or Firm*—Robert S. Babayi; Daniel K. Nichols

[57] ABSTRACT

A stripline structure has a stabilized resonant frequency against temperature variations. It includes a lower and an upper substrate of ceramic materials, each substrate having opposing inner and outer surfaces. Each of the outer surfaces are covered with a layer of conductive material constituting ground planes. Resonator strips of conductive material are situated on each of the inner surfaces, and each have one end connected to the ground, while the opposite end is an open circuit. The upper and lower substrates are bonded together along the length of their respective resonator strips, thereby producing the stripline structure. The length of the resonator determines the resonant frequency of the stripline structure. The two substrates are made of materials having opposite dielectric temperature coefficient. The physical parameters of the stripline structure, such as, thicknesses of the substrates, the widths of the resonator strips, or both can be adjusted in order to produce a net zero, positive or negative frequency temperature coefficient. Furthermore the substrates can be made of dielectric or ferrite materials.

21 Claims, 3 Drawing Sheets

-PRIOR ART-

-PRIOR ART-

200

300

400

TEMPERATURE COMPENSATED STRIPLINE STRUCTURE

BACKGROUND OF THE INVENTION

This invention relates in general to stripline filters and more particularly to a means for stabilizing characteristics of a stripline structures against temperature variations.

Stripline filters are small in size and can be implemented at lower cost than alternative filter structures. A stripline filter is typically fabricated from two layers of a dielectric, having opposing inner and outer surfaces. Layers of conductive material cover each of the opposing outer surfaces and constitute ground planes for the stripline structure. The dielectric substrates enclose at least one resonator wherein one end is grounded and the opposite end is an open circuit. The length of the resonator determines the resonant frequency, and is derived from the following relationship:

$$I=c*f/(4\sqrt{Er\mu r}) \quad (1)$$

where:

I=physical length of the quarter wave resonator;
c=speed of light in a vacuum;
Er=relative dielectric constant of substrate;
$\mu$r=relative permeability of substrate;
f=lowest resonant fequency.

In addition to permeability and dielectric constant another parameter used to characterize a substrate material is the velocity factor Vf. Velocity factor may be readily derived from the following relationship:

$$Vf=1/(\sqrt{Er\mu r}) \quad (2)$$

In dielectric (non-ferrite) materials, the relative permeability is unity therefore, Equation (2) reduces to $$Vf=1/\sqrt{Er} \quad (3)$$

Thus velocity factor and dielectric constant of dielectric material follow an inverse relationship.

Accordingly, it can be concluded that in order to minimize the length of the resonator at a particular resonant frequency, materials having low velocity factors should be utilized. Ceramics such as Neodymium Titanate which have a relatively high dielectric constant (ER>80) are currently being used in the construction of stripline resonators to allow fabrication of small stripline filters in applications such as pagers and portable two-way radios.

FIG. 1 illustrates a cross-sectional view of a conventional stripline structure 100 prior to completion of fabrication. The stripline structure 100 includes substrates 20 and 30 of an identical ceramic dielectric material having equal thicknesses. Substrate 20 includes opposed outer surface 20A and inner surface 20B, and substrate 30 includes opposed inner surface 30A and outer surface 30B. Ground plane layers 40 and 50 of electrically conductive material are situated on surfaces 20A and 30B, respectively, as shown. Two identical and substantially rectangular strips of conductive material 60 and 70 are disposed on surfaces 30A and 20B, respectively.

As shown in FIG. 2, conductive strips 60 and 70 are aligned and soldered together to form a resonator 80. One end of the resonator 80 is grounded, the opposite end is an open circuit (not shown), and the length of the resonator determines the resonant frequency of the stripline structure. Resonator 80 separates the dielectric substrates 20 and 30, thereby producing an air gap 110 within the stripline structure.

Use of ceramics with velocity factors in the range of 0.1 allow fabrication of stripline filters with favorable physical size in frequency ranges above 800 MHZ. However, to fabricate small stripline filters in the UHF (400–512 MHZ) or VHF (130–174 MHZ) frequency ranges, materials with lower velocity factors are needed. Unfortunately contemporary materials with low velocity factors exhibit excessive variation of velocity factor with respect to temperature and therefore are unsuited to construct a frequency stable, UHF stripline structure.

SUMMARY OF THE INVENTION

It is the object of the invention to minimize variation of stripline filter characteristics with respect to temperature.

It is another objective of the invention to provide temperature compensation to enable the use of materials having lower velocity factor in fabrication of stripline filters.

It is yet another objective of this invention to provide a smaller size stripline filter at low frequencies.

In one aspect of the invention, a stripline resonator structure includes two different substrates, each having opposing inner and outer surfaces. A Layer of conductive material is disposed on each outer surface and constitutes the ground plane. Two strips of substantially rectangular conductive material are situated on the inner surfaces. The upper and lower strips are bonded together along their respective length such that inner surfaces face each other, thereby forming the resonator of the stripline structure. One end of the resonator is grounded, while the other end of the resonator is open circuit. The length of the resonator corresponds to the desired resonant frequency. The temperature coefficients of one substrate have properties affecting resonant frequency in one direction, while the other substrate has a temperature coefficient affecting resonant frequency in the opposite direction. The thicknesses of the substrates are adjusted in order to weight the effect of each temperature coefficient on the structure's overall temperature coefficient of velocity factor, and produce a net zero, positive, or negative temperature coefficient.

In another aspect of the invention, utilizing the general foresaid structure, the width of the upper and lower resonator strips are adjusted to produce the desired effect on the net temperature coefficient.

In yet another aspect of the invention, combination of thickness adjustment of the upper and lower substrates and width adjustment of the upper and lower resonator strips are weighting elements in producing the desired effect on net temperature coefficient.

In another aspect of the invention, at least one substrate of low velocity factor ferrite material may be used in the stripline structure. Adjustment of thicknesses of substrates, widths of conductor strips, or both, may be utilized to weight the effect of temperature coefficient of each substrate on resonant frequency in order to produce desired effect on net temperature coefficient of the stripline structure.

DESCRIPTION OF THE PREFERRED EMBODIMENT

Figure 1:
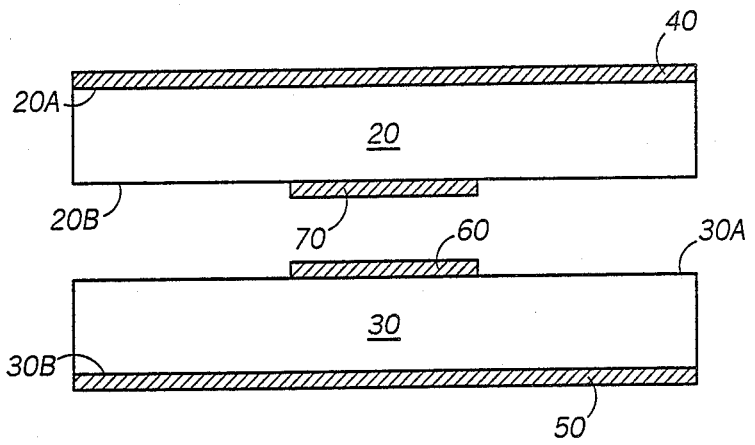
FIG. 1 is a cross-sectional view of prior art stripline structure before assembly.
Figure 2:
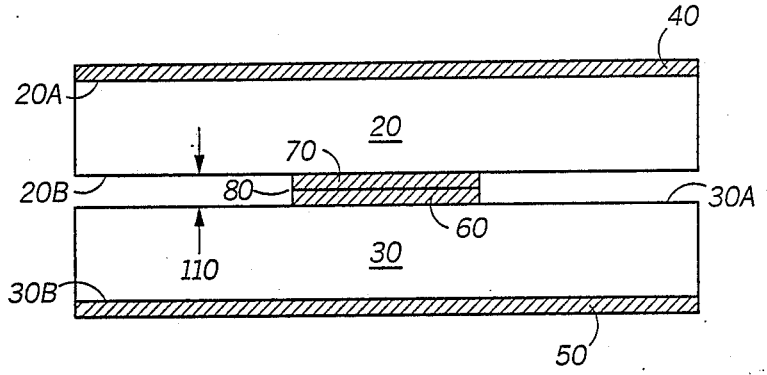
FIG. 2 is a cross-sectional view of stripline structure of FIG. 1 after assembly.
Figure 3:
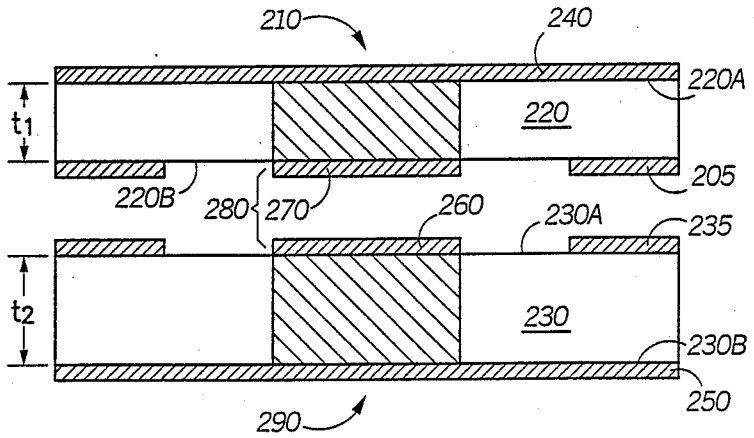
FIG. 3 is a cross-sectional view of one aspect of the invention having substrates of different thicknesses.

FIG. 3 shows the cross-sectinal view of one aspect of the present invention prior to assembly. The Stripline structure 200 includes substrates of 220 and 230 each being made of different ceramic materials. The ceramic substrates 220 and 230 are made of materials having very high dielectric constant, such as Calcium Titanate and Lead Zirconate. Upper substrate 220 includes inner surface 220B and outer surface 220A. Lower Substrate 230 includes inner surface 230A and outer surface 230B. Ground planes 240 and 250 of electrically conductive material are placed on outer surfaces 220A and 230B, respectively.

Figure 4:
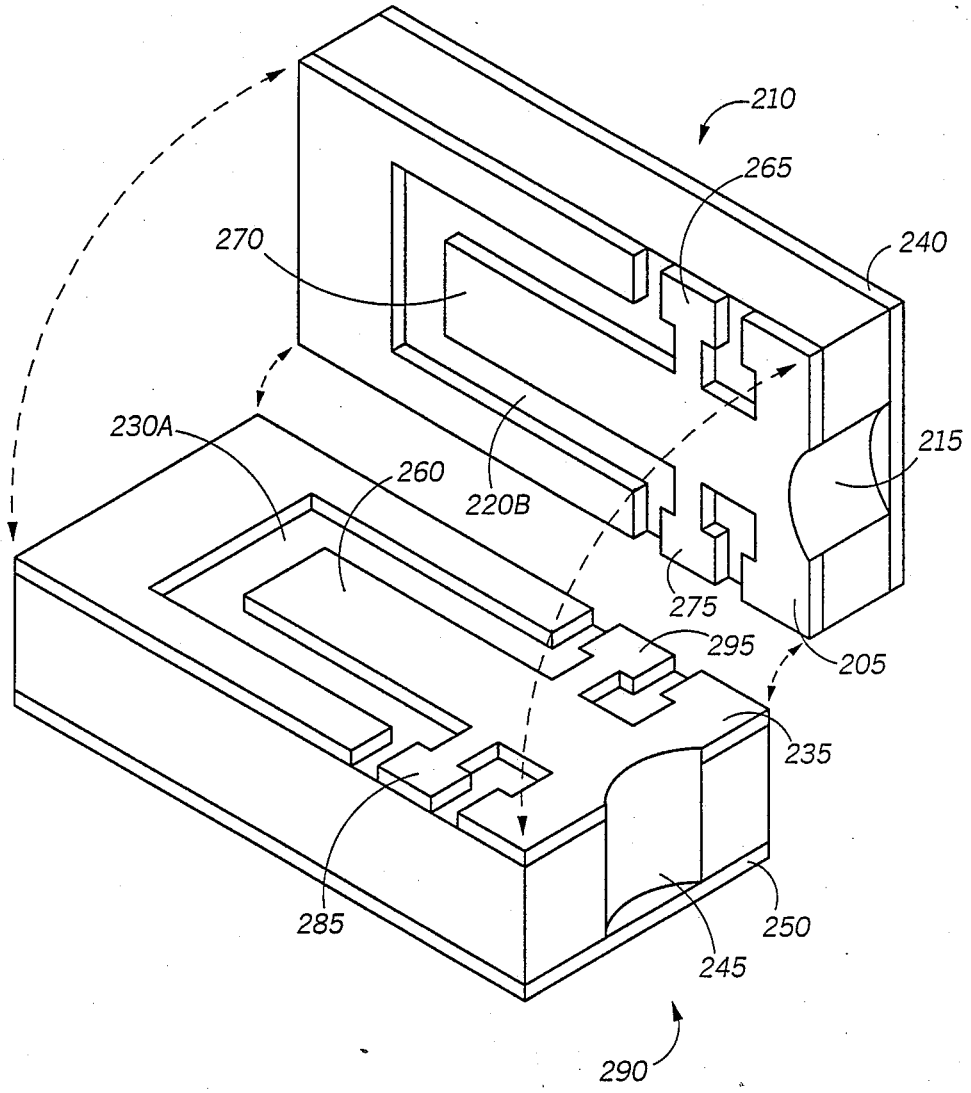
FIG. 4 is a isometric view of the stripline structure of the invention having substrates of different thicknesses.

FIG. 4 shows a isometric view of the stripline structure 200. Electrically conductive ground skirts 205 and 235 are situated around the respective peripheral edges of surfaces 220B and 230A. Ground skirt 205 is connected to ground plane 240 through conductive feed through via 215. Substantially rectangular conductive strips 270 and 260 are situated on surfaces 220B and 230A and respectively have one major axis in parallel with said surfaces. One end of conductive strip 270 is connected to the ground skirt 205, while the other end is an open circuit. An input pad 265 and an output pad 275 are situated on the surface 220B and connect to strip 270. The upper substrate 220 and structures thereon form an upper major structure, 210 and are the mirror image of a lower major structure 290. Therefore ground skirt 235, input pad 285, output pad 295, via 245, and strip 260 are situated on the lower substrate 230 similar to the arrangement of upper substrate 220. The upper structure 210 and lower structure 290 are bonded together, such that surfaces 220B and 230A face each other, thereby producing stripline structure 220. Bonding of major structures 210 and 290 is achieved by soldering the conductive areas of respective inner surfaces 220B and 230A. Strips 270 and 260 are arranged together along their respective lengths and form the resonator 280, wherein one end is grounded. As discussed previously, the length of the resonator 280 determines resonant frequency of the stripline structure.

As mentioned previously, materials having low velocity factors, exhibit significant variation of velocity factor with temperature using currently available ceramic dielectrics. These variations are generally linear and the slope of linearity is the temperature coefficient of the material. In this embodiment the upper substrate 220 is chosen to be a material of low velocity factor having a temperature coefficient with increasing effect on resonant frequency (i.e., positive temperature coefficient), and the lower substrate 230 is also chosen to be a material with low velocity factor but having a temperature coefficient in opposite direction, that is decreasing effect on resonant frequency (i.e., negative temperature coefficient). Clearly, a zero net temperature coefficient of resonant frequency is required in order to produce an ideal temperature stable stripline structure.

In this aspect of the invention the thicknesses t1 and t2 of the substrates 220 and 230 are adjusted in order to weight the effect of temperature coefficient on velocity factor for producing a zero, negative or positive net temperature coefficient of resonant frequency. The following relationship is approximately true for providing a temperature stable stripline structure having a zero net temperature coefficient:

$$t2=-[(Ter2*Er1)/(Ter1*Er1)]t1 \quad (5)$$

where:

t1=thickness of the upper substrate;

t2=thickness of the lowe substrate;

Ter2=temperature coefficient of the dielectric constant of the upper substrate;

Ter2=temperature coefficient of the dielectric constant of the lower substrate;

Er1=Dielectric constant of the upper substrate;

Er2=Dielectric constant of the lower substrate.

Calcium Titanate has a temperature coefficient (Ter) of -2365E-6 and dielectric constant (Er) of 387. Lead Zirconate has a temperature coefficient (Ter) of 3742E-6 and dielectric constant (Er) of 114. For the above stripline structure, a 33.1 mils thick Calcium Titanate substrate and a 15.4 mils thick Lead Zirconate substrate may produce a net temperature coefficient of zero.

Figure 5:
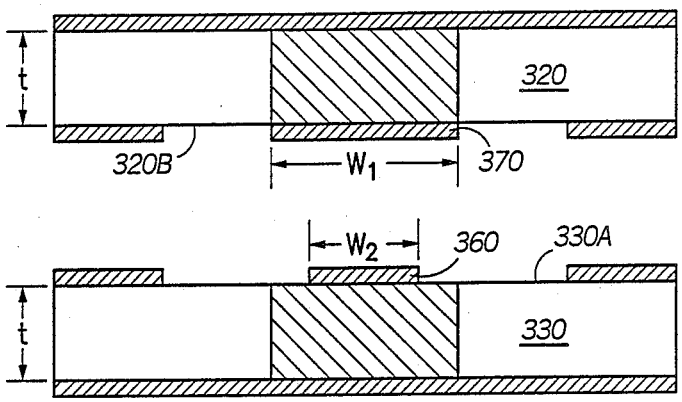
FIG. 5 is a cross-sectional view of another aspect of the invention having resonator strips of different widths.

FIG. 5, shows another aspect of the invention. The stripline structure 300 has the general arrangement of the stripline structure 200 of FIG. 3 and FIG. 4. It includes upper and lower substrates 320 and 330 of high dielectric constant material, with temperature coefficient having opposite effect on resonant frequency, and having substantially identical thickness t. The upper and lower resonator strips 370 and 360 are situated on the inner surfaces 320B and 330A of the substrates 320 and 330. The upper and lower resonator strips 370 and 360 each have different widths W1 and W2. Temperature compensation is achieved by respectively adjusting the widths W1 and W2 of resonator strips 370 and 360. For the temperature stable stripline structure 300, The following approximate relationship exists:

$$W2=-(Ter1*Er1/Ter2*Er2)t1 \quad (5)$$

where:

W1=The width of the upper resonator strip;

W2=The width of the lower resonator strip;

Ter2=temperature coefficient of the dielectric of the upper substrate;

Ter2=temperature coefficient of the dielectric of the lower substrate;

Er1=Dielectric constant of the upper substrate;

Er2=Dielectric constant of the lower substrate.

Therefore the width W1 and W2 may be adjusted to weight the effect of temperature coefficient on velocity factor in order to produce a net zero, negative or positive temperature coefficient of resonant frequency.

This aspect of the invention is particularly advantageous for narrow-band stripline filter applications. When constructing multi-pole narrow band stripline filters utilizing an in-homogeneous stripline structure and unequal substrate thicknesses, non-uniformity in the mode velocities of the edge coupled lines causes the filter to be degraded. This effect can be minimized by using variation of strip widths 470 and 460 to adjust the temperature coefficient while keeping the substrate thickness substantially equally.

Figure 6:
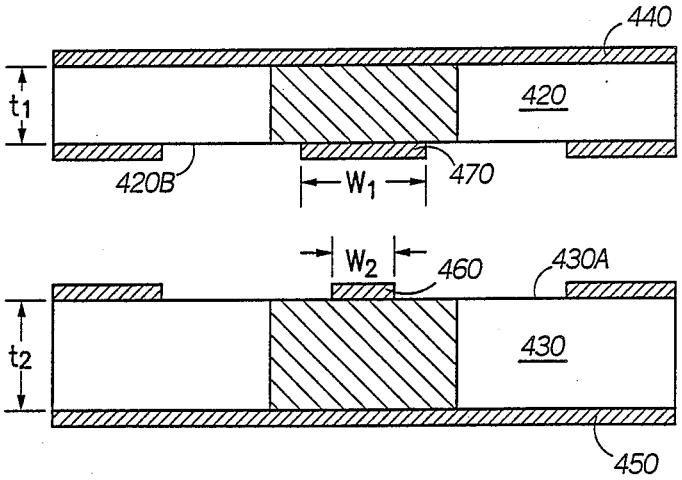
FIG. 6 is a cross-sectional view of yet another aspect of the invention having substrates of different thicknesses and strips of different widths.

FIG. 6 shows yet another aspect of the invention. The stripline structure 400 has the same general arrangement as that of stripline structure 200 explained in FIG. 3 and FIG. 4. The stripline 400 includes two substrates 420 and 430 of high dielectric material, with temperature coefficients in opposite direction, having different thicknesses t1 and t2, and resonator strips 460 and 470 each having different widths W1 and W2. In this aspect of the invention, the stripline structure 400 is temperature compensated by adjusting thicknesses t1 and t2, and further by varying the widths W1 and W2.

The above invention can be extended to include stripline structures having at least one substrate made of ferrite materials. That is, to utilize low velocity factor ferrite substrates, and each substrate having a temperature coefficient with opposite effect on resonant frequency (i.e., increasing or decreasing over temperature) of the stripline structure. Furthermore by adjusting thickness of the ferrite substrate, width of resonator strips, or combination of both the effect of velocity factor can be weighted to produce a net zero, positive or negative temperature coefficient of resonant frequency.

I claim as my invention:

1. A stripline structure, comprising:

a first substrate having inner and outer opposed surfaces, and having a first temperature coefficient and a first thickness;

a second substrate having inner and outer opposed surfaces, and having a second temperature coefficient and a second thickness;

said outer surfaces of first and second substrate each being covered by a conductive material constituting ground planes;

at least one resonator device comprising a first conductor having a first width, situated on the inner surface of said first substrate, and a second conductor having a second width, situated on the inner surface of said second substrate; said first and second substrates being constructed and arranged with their respective inner surfaces facing each other and said first and second temperature coefficients having opposite effect on resonant frequency;

wherein said first and said second thicknesses of said first and second substrate are selected such as to produce a net temperature coefficient of resonant frequency.

2. Stripline structure of claim 1, wherein said net temperature coefficient is zero.

3. Stripline structure of claim 1, wherein said net temperature coefficient is negative.

4. Stripline structure of claim 1, wherein said net temperature coefficient is positive.

5. Stripline structure of claim 1, wherein said substrates comprise dielectric materials.

6. Stripline structure of claim 1, wherein said substrates comprise ferrite materials.

7. Stripline structure of claim 1, wherein said first substrate comprise dielectric materials and said second substrate comprise ferrite materials.

8. A stripline structure, comprising:

a first substrate having inner and outer opposed surfaces, and having a first temperature coefficient and a first thickness;

a second substrate having inner and outer opposed surfaces, and having a second temperature coefficient and a second thickness;

said outer surfaces of first and second substrate each being covered by a conductive material constituting ground planes;

at least one resonator device comprising a first conductor having a first width, situated on the inner surface of said first substrate, and a second conductor having a second width, situated on the inner surface of said second substrate; said first and second substrates being constructed and arranged with their respective inner surfaces facing each other and said first and second temperature coefficients having opposite effect on resonant frequency;

wherein said first and said second widths of said first and second coductors of said resonator are selected such as to produce a net temperature coefficient of resonant frequency.

9. Stripline structure of claim 8, wherein said net temperature coefficient is zero.

10. Stripline structure of claim 8, wherein said net temperature coefficient is negative.

11. Stripline structure of claim 8, wherein said net temperature coefficient is positive.

12. Stripline structure of claim 8, wherein said substrate comprise dielectric materials.

13. Stripline structure of claim 8, wherein said substrates comprise ferrite materials.

14. Stripline structure of claim 8, wherein said first substrate comprise dielectric materials and said second substrate comprise ferrite materials.

15. A stripline structure, comprising:

a first substrate having inner and outer opposed surfaces, and having a first temperature coefficient and a first thickness;

a second substrate having inner and outer opposed surfaces; and having a second temperature coefficient and a second thickness;

said outer surfaces of first and second substrate each being covered by a conductive material constituting ground planes;

at least one resonator device comprising a first conductor having a first width, situated on the inner surface of said first substrate, and a second conductor having a second width, situated on the inner surface of said second substrate; said first and second substrates being constructed and arranged with their respective inner surfaces facing each other and said first and second temperature coefficients having opposite effect on resonant frequency;

wherein combination of said first and said second thicknesses of said first and second substrate, and said first and said second widths of said first and second conductors of said resonator are selected such as to produce a net temperature coefficient of resonant frequency.

16. Stripline structure of claim 15, wherein said net temperature coefficient is zero.

17. Stripline structure of claim 15, wherein said net temperature coefficient is negative.

18. Stripline structure of claim 15, wherein said net temperature coefficient is positive.

19. Stripline structure of claim 15, wherein said substrates comprise dielectric materials.

20. Stripline structure of claim 15, wherein said substrates comprise ferrite materials.

21. Stripline structure of claim 15, wherein said first substrate comprise dielectric materials and said second substrate comprise ferrite materials.

* * * * *